US006102282A

United States Patent [19]

Chuang

[11] Patent Number: 6,102,282

[45] Date of Patent: Aug. 15, 2000

[54] COIN BOX UNIT FOR A COIN-BOX APPARATUS

[76] Inventor: Shou Tsai Chuang, No. 14-33, TenHu Lei, SanHsia Cheng, Taipei Hsien, Taiwan

[21] Appl. No.: 09/327,181

[22] Filed: Jun. 7, 1999

[30] Foreign Application Priority Data

Mar. 26, 1999 [TW] Taiwan ..... 88204715

[51] Int. Cl.[7] ..... G07B 15/00

[52] U.S. Cl. ..... 232/15; 232/57.5; 194/202; 379/145

[58] Field of Search ..... 232/15, 16, 55, 232/57.5; 194/202; 379/143, 145

[56] References Cited

U.S. PATENT DOCUMENTS

| | | | |
|---|---|---|---|
| D. 396,465 | 7/1998 | Chien et al. . | |
| 3,511,939 | 5/1970 | Aikawa . | |
| 5,018,193 | 5/1991 | DeArkland | 232/57.5 X |
| 5,913,475 | 6/1999 | Ashkenazi | 232/57.5 |

*Primary Examiner*—Terry Lee Melius
*Assistant Examiner*—William L. Miller
*Attorney, Agent, or Firm*—Bacon & Thomas, PLLC

[57] ABSTRACT

A coin box unit used in a coin-box apparatus, for example, a coin-box telephone, which includes a base having an oblique plate, an actuating board pivoted to the oblique plate. and a switch hook, wherein the oblique plate has a coin inlet at the top, a through hole in the middle, a coin-return passageway and a coin-receiving passageway at the bottom, the coin-return passageway having an elongated top opening obliquely and downwardly extended to the coin-receiving passageway; the actuating board has a sloping bottom edge, and a rail disposed at the backside along the sloping bottom edge, which defines with the oblique plate and the actuating board a coin guide way extending toward the coin-return passageway and the coin-receiving passageway when the actuating board is closed on the oblique plate; the switch hook is pivoted to the oblique plate and forced to open the actuating board from the oblique plate. Turning the actuating board outwards from the oblique plate enables an inserted object, which is jammed in the coin guide way, to fall to the coin-return passage way.

6 Claims, 4 Drawing Sheets

COIN BOX UNIT FOR A COIN-BOX APPARATUS

BACKGROUND OF THE INVENTION

The present invention relates to a coin box unit for use in for example a coin-box telephone, and more particularly to such a coin box unit, which can easily be operated to let, jammed object or false coin fall to the coin-return assembly.

Besides public telephones, coin-box telephones are commonly used in stores (restaurants, body building centers, beauty parlor, shops, dormitories, etc.). These pay phones are convenient in use. However, children or good-for-nothing people may insert keys, long plates, false coins, or any objects into the coin slot to damage the pay phone. If an object is jammed in the coin passage way in a pay phone, the pay phone owner may have to call the telephone service company to solve the problem.

SUMMARY OF THE INVENTION

The present invention has been accomplished under the circumstances in view. It is one object of the present invention to provide a coin box unit for a coin-box apparatus, which can easily be opened widely to let, jammed object fall to the outside. It is another object of the present invention to provide a coin box unit for a coin-box apparatus that prohibits the insertion of false coin, and automatically guides out inserted false coin. It is still another object of the present invention to provide a coin box unit for a coin-box apparatus that enables the user to eliminate the source of trouble by onesell. To achieve these and other objects of the present invention, there is provided a coin box unit, which comprises a base, an actuating board, and a switch hook. The base comprises an oblique plate. The oblique plate comprises a coin inlet at the upper part of its front side, a through hole on the middle, a coin-return passage way and a coin-receiving passage way at a lower part of its front side. The coin-return passageway has an elongated top portion obliquely downwardly extended to from the coin inlet the coin-receiving passageway, and a coin-return hole at a bottom side. The coin-receiving passageway has a top inlet, and a bottom outlet. The actuating board is pivoted to the oblique plate of the base. and turned relative to the oblique plate between a close position and an open position. The actuating board comprises a top coupling block pivoted to the front side of the oblique plate at its upper portion, a sloping bottom edge, which is disposed in parallel to the elongated top opening of the coin-return passageway at the oblique plate when the actuating board is closed on the oblique plate, a rail at the backside along the sloping bottom edge, which defines with the oblique plate and the actuating board a coin guide way extending toward the coin-return passageway and the coin-receiving passageway when the actuating board is closed on the oblique plate. The switch hook is pivoted to the backside of the oblique plate, comprising a hook portion and a push portion extended from one end of the hook portion. The push portion is inserted through the through hole at the oblique plate and pressed on the backside of the actuating board to push the actuating board away from the oblique plate when the hook portion is pressed down, enabling an inserted object to fall from the rail to the coin-return passageway. When an object is jammed in the coin guide way, the problem can easily be eliminated by opening the actuating board. Further, a return spring may be connected between the switch hook and the oblique plate to keep the switch hook away from the actuating board. The actuating board can be mounted with a spring wire, which projects into the coin guide way to stop light false coin from passing when the actuating board is closed on the oblique plate of the base. The oblique plate can be made having an upper outlet disposed in communication with the coin guide way, and a lower outlet aimed at the coin-return passageway. The upper outlet and the lower outlet communicate with each other at the backside of the oblique plate. When a small false coin runs to the upper outlet, it is guided to the coin-return passageway through the lower outlet. Preferably. a shutter may be mounted in the upper outlet to adjust the size of the upper outlet subject to different coins. A magnet holder can be pivoted to the oblique plate outside the elongated top opening of the coin-return passageway to hold a magnet at a location corresponding to the coin inlet at the oblique plate. The magnet prevents iron-made coins from passing through the coin inlet by means of a magnetic attraction.

DETAILED DESCRIPTION OF THE PREFERRED EMBODIMENT

Figure 1:
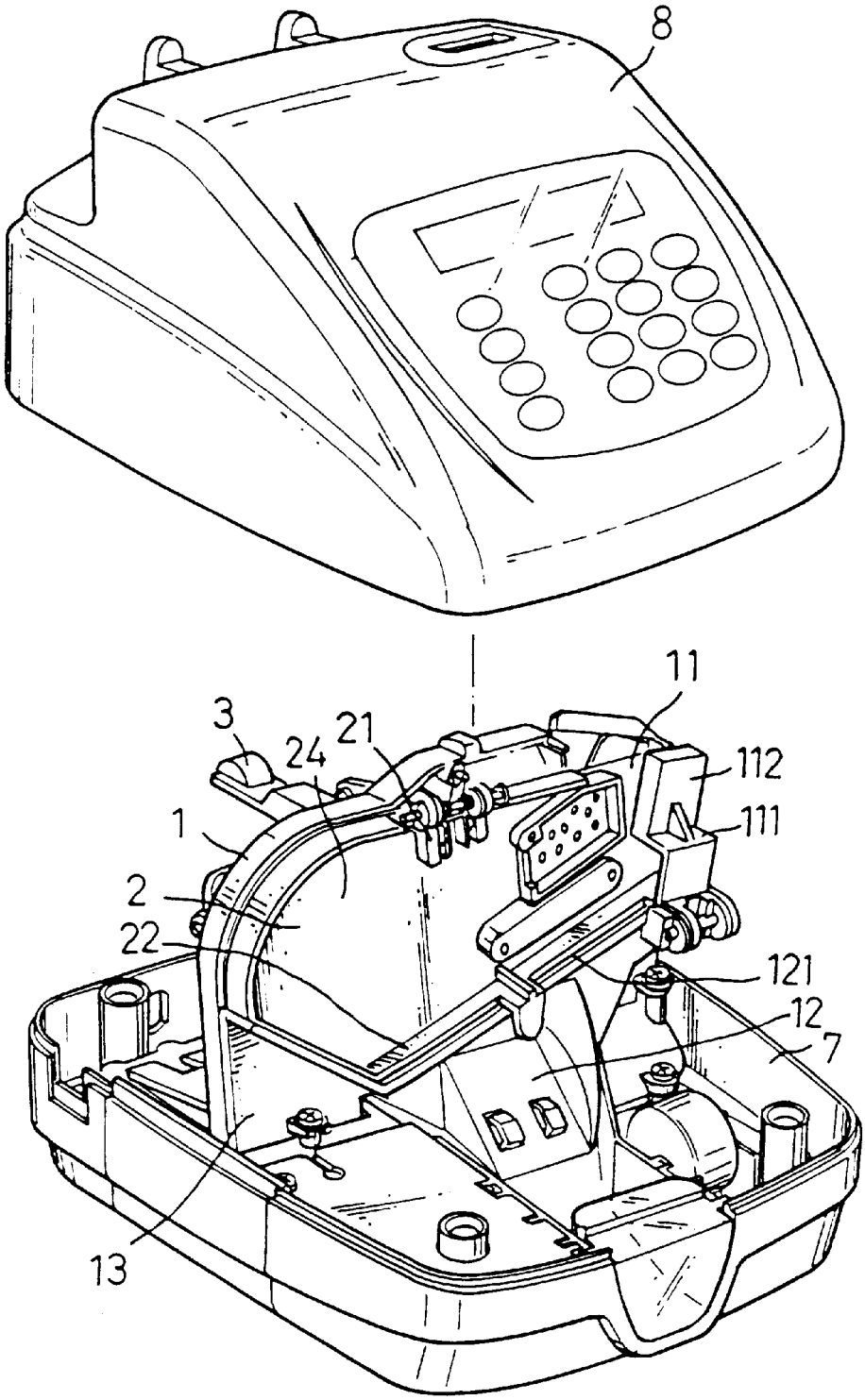
FIG. 1 is an applied view of the present invention showing the coin box unit installed in a coin-box telephone.

The present invention will now be described by way of example with reference to the annexed drawings. FIG. 1 illustrates a coin-box telephone (pay phone) constructed according to the present invention. The coin box unit of the present invention is installed in the casing 7 of the coin-box telephone, and covered by a top cover 8.

Figure 2:
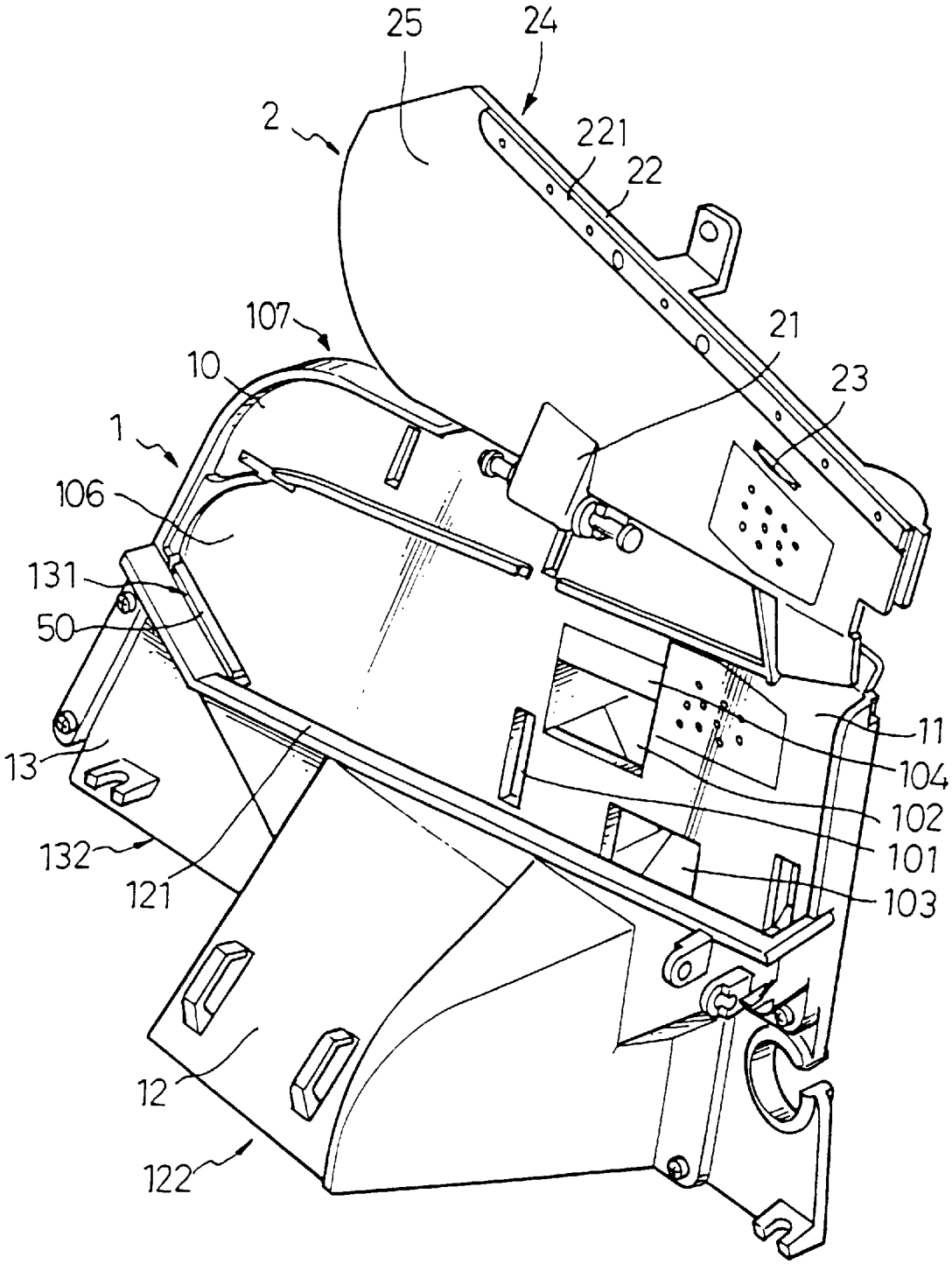
FIG. 2 is a perspective view of the present invention, showing the actuating board of the coin box unit opened widely.
Figure 3:
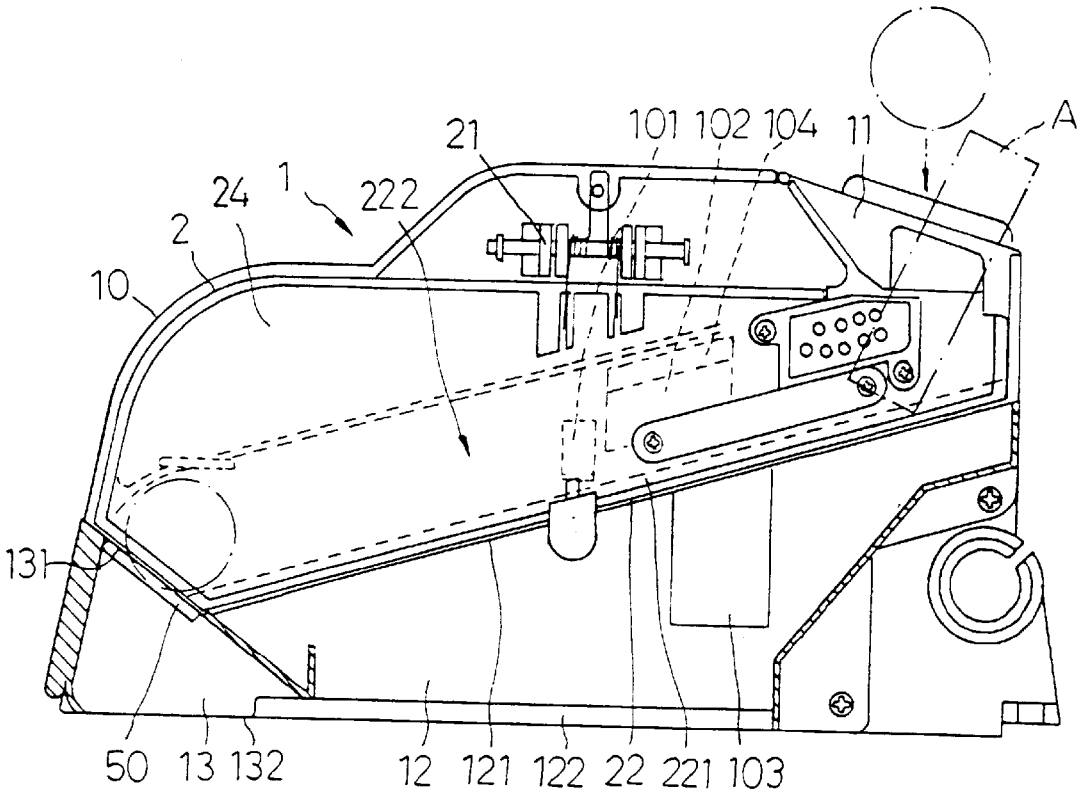
FIG. 3 is a front view of the present invention, showing the actuating board of the coin box unit closed.

Referring to FIGS. 2 and 3, the coin box unit comprises a base 1 having an oblique plate 10. The oblique plate 10 defines a front 106, a back side 107, a coin inlet 11 at the upper part of its front side 106. a through hole 101 on the middle. a coin-return passageway 12 and a coin-receiving passageway 13 at the lower part of its front side 106. The coin-return passageway 12 and the coin-receiving passageway 13 are separated from each other by partition means. The coin-return passage way 12 has an elongated top opening 121 obliquely downwardly extended from the coin inlet 11 to the coin-receiving passage way 12, and a coin-return hole 122 at the bottom side. The coin-receiving passageway 13 has an inlet 131 at the top side, and an outlet 132 at the bottom side.

An actuating board 2 is pivoted to the oblique plate 10 of the base 1 at its upper portion. FIG. 2 shows the actuating board 2 turned outwards from the oblique plate 10 of the base 1 to the maximum angle. The actuating board 2 comprises a coupling block 21 pivoted to the front side of 106 the oblique plate 10 at the top, and a sloping bottom edge 22. As shown in FIG. 3, when the actuating board 2 is closed on the oblique plate 10, the sloping bottom edge 22 of the actuating board 2 is disposed in parallel to the elongated top opening 121 at the oblique plate 10.

Figure 4:
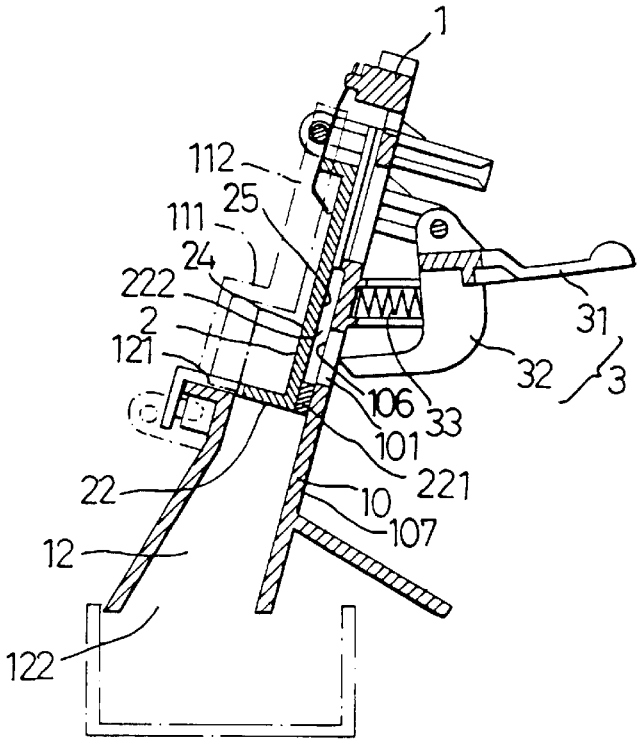
FIG. 4 is a sectional view of the present invention, showing the switch hook released.

Referring also to FIG. 4, the actuating board 2 comprises a front side 24, a backside 25, and a rail 221 at its backside 25 along the sloping bottom edge 22. When the actuating board 2 is closed on the oblique plate 10, the top side wall of the rail 221 of the actuating board 2 defines with the front side 106 of the oblique plate 10 and the backside 25 of the actuating board 2 a coin guide way 222. A switch hook 3 is pivoted to the backside 107 of the oblique plate 10. The switch hook 3 comprises a hook portion 31, and a push portion 32. The push portion 32 can be inserted through the through hole 101 at the oblique plate 10, and then stopped at the backside 25 of the actuating board 2. A return spring 33 is connected between the switch hook 3 and the oblique plate 10. The spring power of the return spring 33 keeps the push portion 32 spaced from the actuating board 2.

During a normal use as shown in FIG. 3, coin is inserted into the coin inlet 11, then guided through the coin guide way 222 and stopped by a baffle 50 at the top inlet 131 of the coin-receiving passage way 13. When the electromagnetic valve (not shown) behind the oblique plate 10 receives a message to opening the baffle 50, inserted coin falls to the coin receiving passage way 13, and is further collected in a coin box (not shown). If a key or a long plate A is inserted, it would be stopped at the inlet 11.

Figure 5:
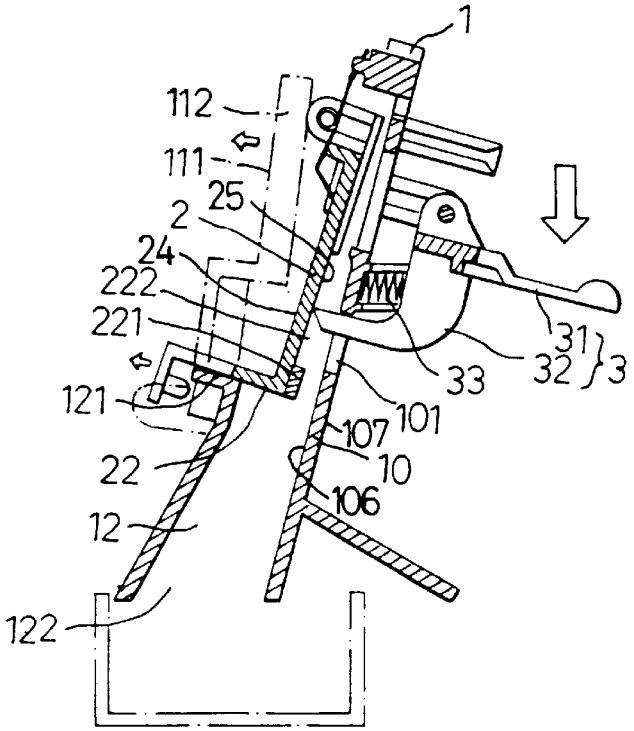
FIG. 5 is similar to FIG. 4 but showing the switch hook depressed, the actuating board opened.

Referring to FIG. 5, when the hook portion 31 is pressed down, the actuating board 2 is pushed open by the push portion 32, enabling inserted coin to fall from the rail 221 to the coin-return passage way 12. When inserted coin or false object (e.g. long plate A) is heavily jammed in the coin guide way 222, the source of trouble can easily be eliminated by turning the actuating board 2 widely from the oblique plate 10 (see FIG. 2).

Referring to FIG. 2 again, the actuating board 2 has a spring wire 23 projected into the coin guide way 22 to stop lightweight coin from passing. An upper outlet 102 and a lower outlet 103 are provided at the actuating board 2. The upper outlet 102 is disposed in communication with the coin guide way 222. The lower outlet 103 is aimed at the coin-return passage way 12. The upper outlet 102 and the lower outlet 103 communicate with each other at the backside 107 of the oblique plate 10. When inserted coin of small diameter passes through the coin guide way 222, it goes into the upper outlet 102, and then falls to the coin-return passageway 12 through the lower outlet 103. The upper outlet 102 is relatively bigger than the diameter of small false coin. A shutter 104 is replaceable mounted in the upper outlet 102 at the topside. By replacing a different size of shutter 104, the size of the upper outlet 102 is relatively adjusted to fit different coins of different country.

Referring, to FIGS. 1, 4, and 5 again, a magnet holder 111 is pivoted to the oblique plate 10 outside the obliquely extended top opening 121 to hold a magnet 112 at a location corresponding to the coin inlet 11. When the actuating board 2 is closed the magnet 112 is disposed adjacent to the coin inlet 11, therefore the magnet 112 can retain inserted iron-made coin by means of magnetic attraction in the coin inlet 11 (see FIGS. 1 and 4). When the hook portion 31 is pressed down to move the actuating board 2 outwards from the oblique plate 10, the magnet 112 is moved with the actuating board 2 from the coin inlet 11, enabling iron-made coin to fall to the coin-return passage way 12 (see FIG. 5).

While only one embodiment of the present invention has been shown and described, it will be understood that various modifications and changes could be made thereunto without departing from the spirit and scope of the invention disclosed.

What the invention claimed is:

1. A coin box unit used in a coin-box apparatus, comprising:

a base, said base comprising an oblique plate, said oblique plate comprising a front side a back side, a coin inlet at an upper part of said front side, a through hole in the middle of said front side, a coin-return passage way and a coin-receiving passage way at a lower part of said front side, said coin-return passage way having an elongated top opening obliquely and downwardly extended from said coin inlet to said coin-receiving passage way and a coin-return hole at a bottom side, said coin-receiving passage way having a top inlet and a bottom outlet;

an actuating board pivoted to said oblique plate of said base and turned relative to said oblique plate between a closed position and an open position, said actuating board comprising a front side, a back side, a top coupling block pivoted to the front side of said oblique plate at an upper portion, a sloping bottom edge, which is disposed in parallel to said elongated top opening of said coin-return passage way at said oblique plate when said actuating board is closed on said oblique plate, a rail at said back side thereof along said sloping bottom edge, which defines with said oblique plate and said actuating board a coin guide way extending toward said coin-return passage way and said coin-receiving passage way when said actuating board is closed on said oblique plate; and a switch hook pivoted to the back side of said oblique plate, said switch hook comprising a hook portion and a push portion extended from one end of said hook portion;

wherein said push portion is inserted through the through hole at said oblique plate and pressed on the back side of said actuating board to push said actuating board away from said oblique plate when said hook portion is pressed down, such that when an object is inserted into said coin guide way, the inserted object will fall from said rail to said coin-return passage way.

2. The coin box unit of claim 1 wherein said actuating board comprises a spring wire, which projects into said coin guide way when said actuating board is closed on said oblique plate of said base.

3. The coin box unit of claim 1 wherein said oblique plate comprises an upper outlet disposed in communication with said coin guide way, and a lower outlet aimed at said coin-return passageway, said upper outlet and said lower outlet communicating with each other at the backside of said oblique plate.

4. The coin box unit of claim 3 wherein a shutter is mounted in said upper outlet.

5. The coin box unit of claim 1 further comprising a magnet holder pivoted to said oblique plate outside said elongated top opening of said coin-return passage way to hold a magnet at a location corresponding to said coin inlet at said oblique plate.

6. The coin box unit of claim 1 further comprising a return spring connected between said switch hook and said oblique plate to keep said switch hook away from said actuating board.

* * * * *